US008037623B2

(12) United States Patent
Passke et al.

(10) Patent No.: US 8,037,623 B2
(45) Date of Patent: Oct. 18, 2011

(54) ARTICLE OF FOOTWEAR INCORPORATING A FLUID SYSTEM

(75) Inventors: Joel Passke, Hillsboro, OR (US); Fred Dojan, Vancouver, WA (US); Peter K. Hazenberg, Portland, OR (US); John Swigart, Portland, OR (US)

(73) Assignee: Nike, Inc., Beaverton, OR (US)

( * ) Notice: Subject to any disclaimer, the term of this patent is extended or adjusted under 35 U.S.C. 154(b) by 713 days.

(21) Appl. No.: 11/476,607

(22) Filed: Jun. 29, 2006

(65) Prior Publication Data

US 2006/0272179 A1 Dec. 7, 2006

Related U.S. Application Data

(63) Continuation of application No. 11/053,697, filed on Feb. 7, 2005, now Pat. No. 7,210,249, which is a continuation of application No. 09/887,523, filed on Jun. 21, 2001, now abandoned.

(51) Int. Cl.
*A43B 13/20* (2006.01)

(52) U.S. Cl. ..... 36/29; 36/153

(58) Field of Classification Search ..... 36/29, 153, 36/28, 88, 71, 3 B

See application file for complete search history.

(56) References Cited

U.S. PATENT DOCUMENTS

| | | | |
|---|---|---|---|
| 82,944 | A | 10/1868 | Haskins |
| 167,732 | A | 10/1875 | Blanchard |
| 180,819 | A | 8/1876 | Ames |
| 212,898 | A | 3/1879 | Class |
| 508,034 | A | 11/1893 | Moore |
| 510,504 | A | 12/1893 | Foster |
| 536,345 | A | 3/1895 | Harris |
| 545,705 | A | 9/1895 | MacDonald |
| 547,645 | A | 10/1895 | LaCroix |
| 566,422 | A | 8/1896 | Singleton |
| 580,501 | A | 4/1897 | Mobberley |
| 586,155 | A | 7/1897 | Bascom |
| 634,588 | A | 10/1899 | Roche |
| D32,093 | S | 1/1900 | Childs |
| 692,170 | A | 1/1902 | Wallerstein et al. |
| 710,674 | A | 10/1902 | Fassmann |
| 850,327 | A | 4/1907 | Tauber |

(Continued)

FOREIGN PATENT DOCUMENTS

| | | |
|---|---|---|
| BR | 8305004 | 9/1983 |

(Continued)

OTHER PUBLICATIONS

Gore PreVEnt Membrane Vents for Electronic Housings Pamphlet, published Jun. 2000.

(Continued)

*Primary Examiner* — Ted Kavanaugh
(74) *Attorney, Agent, or Firm* — Banner & Witcoff, Ltd.

(57) ABSTRACT

An article of athletic footwear having an air-filled bladder disposed in a sole structure is disclosed. The air-filled bladder is in fluid communication with ambient air through a filter that permits ambient air to enter the bladder but restricts liquids and particulates from entering the bladder. In operation, the filter and bladder may be portions of a bladder system that absorb shock when the footwear contacts a playing surface. Alternatively, the filter and bladder may be portions of a bladder system that ventilates the interior of the footwear. The filter may be formed of a material such as expanded polytetrafluoroethylene that is attached to a carrier.

1 Claim, 4 Drawing Sheets

U.S. PATENT DOCUMENTS

| | | | |
|---|---|---|---|
| 900,867 | A | 10/1908 | Miller |
| 918,391 | A | 4/1909 | Taarud |
| 950,333 | A | 2/1910 | Koch |
| 1,034,915 | A | 8/1912 | Kaiser |
| 1,053,204 | A | 2/1913 | Morrison |
| 1,059,485 | A | 4/1913 | Orlopp |
| 1,069,001 | A | 7/1913 | Guy |
| 1,071,271 | A | 8/1913 | Spangler |
| 1,145,534 | A | 7/1915 | Wetmore |
| 1,148,376 | A | 7/1915 | Gay |
| 1,193,608 | A | 8/1916 | Poulson |
| 1,198,476 | A | 9/1916 | Pearson |
| 1,216,795 | A | 2/1917 | Gause |
| 1,235,645 | A | 8/1917 | Blatz et al. |
| 1,241,832 | A | 10/1917 | Drunkenmiller |
| 1,257,086 | A | 2/1918 | Marcellus |
| 1,285,695 | A | 11/1918 | Harman |
| 1,304,915 | A | 5/1919 | Spinney |
| 1,322,338 | A | 11/1919 | Pitts |
| 1,328,154 | A | 1/1920 | Jackerson |
| D55,436 | S | 6/1920 | Seiders |
| 1,369,555 | A | 2/1921 | Schweinert et al. |
| 1,383,067 | A | 6/1921 | Borman |
| 1,422,716 | A | 7/1922 | Jones |
| 1,444,189 | A | 2/1923 | Key |
| 1,450,934 | A | 4/1923 | Wilson |
| 1,498,838 | A | 6/1924 | Harrison, Jr. |
| 1,531,731 | A | 3/1925 | Burgess |
| 1,602,675 | A | 10/1926 | Hurley |
| 1,605,985 | A | 11/1926 | Rasmussen |
| 1,630,445 | A | 5/1927 | Murray |
| 1,637,219 | A | 7/1927 | Edelmann |
| 1,776,750 | A | 9/1930 | Burns |
| 1,802,523 | A | 4/1931 | Morangier |
| 1,818,178 | A | 8/1931 | Weisberg |
| 1,869,257 | A | 7/1932 | Hitzler |
| 1,940,542 | A | 12/1933 | Goth |
| 1,954,122 | A | 4/1934 | Fiori |
| 1,979,972 | A | 11/1934 | Guild |
| 2,001,821 | A | 5/1935 | Everston |
| 2,002,527 | A | 5/1935 | Dorogi et al. |
| 2,007,803 | A | 6/1935 | Kelly |
| 2,015,882 | A | 10/1935 | Brewer |
| 2,016,113 | A | 10/1935 | Lambert et al. |
| 2,020,240 | A | 11/1935 | Cochran |
| 2,036,695 | A | 4/1936 | Heigis |
| 2,038,473 | A | 4/1936 | Bronson |
| 2,070,116 | A | 2/1937 | Cutillo |
| 2,074,286 | A | 3/1937 | Sullivan |
| 2,080,469 | A | 5/1937 | Gilbert |
| 2,080,499 | A | 5/1937 | Nathansohn |
| 2,147,197 | A | 2/1939 | Glidden |
| 2,177,116 | A | 10/1939 | Persichino |
| 2,205,938 | A | 6/1940 | Ward |
| 2,275,720 | A | 3/1942 | Bingham, Jr. |
| D133,459 | S | 8/1942 | Corley |
| 2,325,639 | A | 8/1943 | Stritter |
| 2,368,091 | A | 1/1945 | Andersen |
| 2,476,545 | A | 7/1949 | Hayward |
| 2,488,382 | A | 11/1949 | Davis |
| 2,498,596 | A | 2/1950 | Wallach |
| 2,532,742 | A | 12/1950 | Stoiner |
| 2,533,685 | A | 12/1950 | Nurkiewicz |
| 2,574,028 | A | 11/1951 | Fields et al. |
| 2,575,908 | A | 11/1951 | Clifford |
| 2,579,977 | A | 12/1951 | Sjolin |
| 2,600,239 | A | 6/1952 | Gilbert |
| 2,605,560 | A | 8/1952 | Gouabault |
| 2,622,052 | A | 12/1952 | Chandler |
| 2,638,690 | A | 5/1953 | Bullard, III |
| 2,677,904 | A | 5/1954 | Reed |
| 2,677,906 | A | 5/1954 | Reed |
| 2,678,506 | A | 5/1954 | Baroumes |
| 2,682,712 | A | 8/1954 | Cooksley |
| 2,686,081 | A | 8/1954 | Cooksley |
| 2,693,221 | A | 11/1954 | Lyijynen |
| 2,698,490 | A | 1/1955 | Goldman |
| 2,717,100 | A | 9/1955 | Engelder |
| 2,717,556 | A | 9/1955 | Bartoo |
| 2,762,134 | A | 9/1956 | Town |
| 2,774,152 | A | 12/1956 | Alber |
| 2,775,401 | A | 12/1956 | Storrs |
| 2,845,032 | A | 7/1958 | Krohm |
| 2,860,634 | A | 11/1958 | Duncan et al. |
| 2,863,230 | A | 12/1958 | Cortina |
| 2,878,683 | A | 3/1959 | Huthsing, Sr. et al. |
| 2,942,614 | A | 6/1960 | Lardner |
| 2,949,927 | A | 8/1960 | Mackal |
| 2,981,010 | A | 4/1961 | Aaskov |
| 2,982,448 | A | 5/1961 | Leonard et al. |
| 3,015,414 | A | 1/1962 | Wilson |
| 3,027,659 | A | 4/1962 | Gianola |
| 3,044,190 | A | 7/1962 | Urbany |
| 3,062,152 | A | 11/1962 | Huff, Sr. |
| 3,068,494 | A | 12/1962 | Pinkwater |
| 3,078,679 | A | 2/1963 | Mortimer et al. |
| 3,080,094 | A | 3/1963 | Moddemo |
| 3,120,712 | A | 2/1964 | Menken |
| 3,180,039 | A | 4/1965 | Burns, Jr. |
| D201,606 | S | 7/1965 | McCord |
| 3,196,062 | A | 7/1965 | Kristal |
| 3,211,164 | A | 10/1965 | Bender et al. |
| 3,221,932 | A | 12/1965 | Anderson |
| 3,225,463 | A | 12/1965 | Burnham |
| 3,245,428 | A | 4/1966 | Klimak et al. |
| 3,256,131 | A | 6/1966 | Koch et al. |
| D205,276 | S | 7/1966 | Kort |
| 3,273,263 | A | 9/1966 | Klima |
| 3,329,983 | A | 7/1967 | Clamp |
| 3,331,146 | A | 7/1967 | Karras |
| 3,372,495 | A | 3/1968 | Finn |
| 3,397,418 | A | 8/1968 | Steadman et al. |
| 3,410,004 | A | 11/1968 | Finn |
| 3,426,787 | A | 2/1969 | Fuller |
| 3,484,881 | A | 12/1969 | Krleger |
| D216,694 | S | 3/1970 | Lause |
| 3,548,869 | A | 12/1970 | Weise et al. |
| 3,586,003 | A | 6/1971 | Baker |
| D221,432 | S | 8/1971 | Dunlap |
| 3,628,531 | A | 12/1971 | Harris |
| 3,642,563 | A | 2/1972 | Davis et al. |
| 3,658,208 | A | 4/1972 | Hansen |
| 3,664,043 | A | 5/1972 | Polumbus, Jr. |
| 3,685,176 | A | 8/1972 | Rudy |
| 3,716,930 | A | 2/1973 | Brahm |
| 3,721,265 | A | 3/1973 | Hoffland |
| 3,739,414 | A | 6/1973 | Skelham |
| D227,888 | S | 7/1973 | Felix |
| 3,744,159 | A | 7/1973 | Nishimura |
| 3,760,056 | A | 9/1973 | Rudy |
| 3,765,422 | A | 10/1973 | Smith |
| 3,776,227 | A | 12/1973 | Pitesky et al. |
| 3,791,375 | A | 2/1974 | Pfeiffer |
| 3,834,433 | A | 9/1974 | Thompson |
| 3,854,228 | A | 12/1974 | Conroy |
| 3,888,242 | A | 6/1975 | Harris et al. |
| 3,931,685 | A | 1/1976 | Laukaitis |
| 3,973,336 | A | 8/1976 | Ahn |
| 3,983,907 | A | 10/1976 | Sorensen |
| 3,985,155 | A | 10/1976 | Nightingale |
| 3,993,099 | A | 11/1976 | Nightingale |
| 3,995,653 | A | 12/1976 | Mackal et al. |
| 3,996,957 | A | 12/1976 | Goldish et al. |
| D243,457 | S | 2/1977 | Ryan |
| 4,014,048 | A | 3/1977 | Rappleyea |
| 4,039,039 | A | 8/1977 | Gottfried |
| 4,044,867 | A | 8/1977 | Fisher |
| 4,054,163 | A | 10/1977 | Brown, Jr. et al. |
| D246,486 | S | 11/1977 | Nickel |
| 4,069,602 | A | 1/1978 | Kremer et al. |
| 4,078,322 | A | 3/1978 | Dalebout |
| 4,083,127 | A | 4/1978 | Hanson |
| 4,088,147 | A | 5/1978 | Krechel et al. |
| 4,100,686 | A | 7/1978 | Sgarlato et al. |
| 4,106,222 | A | 8/1978 | Houck |
| D249,279 | S | 9/1978 | Backlund |
| 4,123,855 | A | 11/1978 | Thedford |

4,129,951 A 12/1978 Petrosky
D252,703 S 8/1979 Cupit
4,168,015 A 9/1979 Robinette
4,169,353 A 10/1979 Fresard
4,183,156 A 1/1980 Rudy
4,217,705 A 8/1980 Donzis
4,219,945 A * 9/1980 Rudy ..... 36/29
4,222,183 A 9/1980 Haddox
4,232,459 A 11/1980 Vaccari
4,271,606 A 6/1981 Rudy
4,297,755 A 11/1981 Mollura
4,316,334 A 2/1982 Hunt
4,316,335 A 2/1982 Giese et al.
4,335,530 A 6/1982 Stubblefield
4,340,626 A 7/1982 Rudy
4,342,157 A 8/1982 Gilbert
4,361,969 A 12/1982 Vermonet
4,370,997 A 2/1983 Braithwaite et al.
4,372,297 A 2/1983 Perlin
4,397,104 A 8/1983 Doak
4,398,357 A 8/1983 Batra
4,399,621 A 8/1983 Dassler
4,417,407 A 11/1983 Fukuoka
4,439,937 A 4/1984 Daswick
4,446,634 A 5/1984 Johnson et al.
4,454,662 A 6/1984 Stubblefield
4,457,335 A 7/1984 Trick
4,458,429 A 7/1984 Schmid
4,458,430 A 7/1984 Peterson
4,462,171 A 7/1984 Whispell
4,485,568 A 12/1984 Landi et al.
4,489,855 A 12/1984 Boetger
4,490,928 A 1/1985 Kawashima
4,506,695 A 3/1985 Kuypers
4,507,880 A 4/1985 Ohashi
4,508,582 A 4/1985 Fink
4,535,554 A 8/1985 De Obaldia B.
4,541,186 A 9/1985 Mulvihill
4,542,598 A 9/1985 Misevich et al.
4,546,559 A 10/1985 Dassler
4,547,979 A 10/1985 Harada et al.
D281,350 S 11/1985 Heier
4,550,510 A 11/1985 Stubblefield
4,571,853 A 2/1986 Medrano
4,571,995 A 2/1986 Timme
4,578,883 A 4/1986 Dassler
4,579,141 A 4/1986 Arff
D284,264 S 6/1986 Resan
D284,265 S 6/1986 Resan
D285,716 S 9/1986 Bova
4,608,769 A 9/1986 Sturlaugson
4,610,099 A 9/1986 Signori
4,628,945 A 12/1986 Johnson, Jr.
4,641,438 A 2/1987 Laird et al.
4,642,917 A 2/1987 Ungar
4,649,552 A 3/1987 Yukawa
4,651,445 A 3/1987 Hannibal
4,654,986 A 4/1987 George
4,658,869 A 4/1987 Soon-Fu
4,662,087 A 5/1987 Beuch
4,662,412 A 5/1987 Swallert
4,669,498 A 6/1987 Hansen
4,670,995 A 6/1987 Huang
4,676,010 A 6/1987 Cheskin
4,681,148 A 7/1987 Decker, Jr. et al.
4,694,520 A 9/1987 Paul et al.
4,694,591 A 9/1987 Banich et al.
4,694,850 A 9/1987 Fumino
4,700,403 A 10/1987 Vacanti
4,702,022 A 10/1987 Porcher
4,722,131 A 2/1988 Huang
4,724,627 A 2/1988 Sisco
4,729,543 A 3/1988 Aricha
4,730,403 A 3/1988 Walkhoff
4,736,531 A 4/1988 Richard
4,744,157 A 5/1988 Dubner
D296,581 S 7/1988 Hattori
4,760,651 A 8/1988 Pon-Tzu
4,763,426 A 8/1988 Polus et al.
4,771,554 A 9/1988 Hannemann
4,773,454 A 9/1988 Kroh et al.
4,774,776 A 10/1988 Gulli
4,776,110 A 10/1988 Shiang
4,778,595 A 10/1988 Sable et al.
4,779,359 A 10/1988 Famolare, Jr.
D299,379 S 1/1989 Haggerty et al.
4,805,601 A 2/1989 Eischen, Sr.
4,811,497 A 3/1989 Merino Ciudad
4,817,303 A 4/1989 Selbiger
4,823,482 A 4/1989 Lakic
4,835,883 A 6/1989 Tetrault et al.
D302,764 S 8/1989 Peoples et al.
4,852,274 A 8/1989 Wilson
4,854,057 A 8/1989 Misevich et al.
4,856,208 A 8/1989 Zaccaro
RE33,066 E 9/1989 Stubblefield
4,874,640 A 10/1989 Donzis
4,877,057 A 10/1989 Christensen
4,878,300 A 11/1989 Bogaty
4,887,367 A 12/1989 Mackness et al.
4,888,887 A 12/1989 Solow
4,906,502 A 3/1990 Rudy
4,910,889 A 3/1990 Bonaventure et al.
4,912,861 A 4/1990 Huang
D307,508 S 5/1990 Miller et al.
4,922,631 A 5/1990 Anderie
4,934,543 A 6/1990 Schmidt
D309,211 S 7/1990 Nakagawa
4,969,493 A 11/1990 Lee
D314,172 S 1/1991 Whitley, II
4,991,317 A 2/1991 Lakic
4,995,124 A 2/1991 Wridge, Jr. et al.
4,995,173 A 2/1991 Spier
4,999,072 A 3/1991 Dischler
5,010,661 A 4/1991 Chu
5,012,954 A 5/1991 Will
5,020,395 A 6/1991 Mackey
5,022,565 A 6/1991 Sturman et al.
5,025,575 A 6/1991 Lakic
5,042,176 A 8/1991 Rudy
5,052,130 A 10/1991 Barry et al.
5,056,992 A 10/1991 Simons et al.
5,060,694 A 10/1991 Florida et al.
5,070,829 A 12/1991 Guntly et al.
5,074,765 A 12/1991 Pekar
D323,419 S 1/1992 Miller et al.
5,083,320 A 1/1992 Halstead
5,083,581 A 1/1992 Jaw
5,111,838 A 5/1992 Langston
5,113,599 A 5/1992 Cohen et al.
5,121,840 A 6/1992 Schram
D327,769 S 7/1992 Serna et al.
5,129,107 A 7/1992 Lorenzo
5,129,109 A 7/1992 Runckel
5,131,173 A 7/1992 Anderie
5,135,025 A 8/1992 Mackal
D329,733 S 9/1992 Miller et al.
5,144,708 A 9/1992 Pekar
5,155,864 A 10/1992 Walker et al.
5,155,865 A 10/1992 Walker et al.
5,155,866 A 10/1992 Walker et al.
5,155,927 A 10/1992 Bates et al.
5,158,767 A 10/1992 Cohen et al.
5,181,279 A 1/1993 Ross
5,185,943 A 2/1993 Tong et al.
5,191,727 A 3/1993 Barry et al.
5,193,246 A 3/1993 Huang
5,195,254 A 3/1993 Tyng
5,230,249 A 7/1993 Sasaki et al.
5,234,015 A 8/1993 Fumino
5,243,772 A 9/1993 Francis et al.
5,253,435 A 10/1993 Auger et al.
D341,189 S 11/1993 Legassie et al.
5,295,313 A 3/1994 Lee
5,313,717 A 5/1994 Allen et al.
5,317,819 A 6/1994 Ellis, III
5,319,866 A 6/1994 Foley et al.
5,335,382 A 8/1994 Huang

| | | | | |
|---|---|---|---|---|
| 5,343,638 | A | 9/1994 | Legassie et al. | |
| 5,351,710 | A | 10/1994 | Phillips | |
| 5,353,525 | A | 10/1994 | Grim | |
| 5,355,552 | A | 10/1994 | Huang | |
| 5,375,345 | A | 12/1994 | Djuric | |
| 5,381,607 | A | 1/1995 | Sussmann | |
| 5,390,430 | A | 2/1995 | Fitchmun et al. | |
| 5,392,534 | A | 2/1995 | Grim | |
| 5,400,526 | A | 3/1995 | Sessa | |
| 5,406,661 | A | 4/1995 | Pekar | |
| 5,406,719 | A * | 4/1995 | Potter | 36/28 |
| 5,408,760 | A | 4/1995 | Tse et al. | |
| 5,477,626 | A | 12/1995 | Kwon | |
| 5,505,010 | A | 4/1996 | Fukuoka | |
| 5,544,429 | A | 8/1996 | Ellis, III | |
| 5,558,395 | A | 9/1996 | Huang | |
| 5,598,644 | A | 2/1997 | Polegato | |
| 5,669,161 | A | 9/1997 | Huang | |
| 5,701,687 | A | 12/1997 | Schmidt et al. | |
| 5,771,606 | A * | 6/1998 | Litchfield et al. | 36/29 |
| 5,784,807 | A | 7/1998 | Pagel | |
| 5,806,208 | A | 9/1998 | French | |
| 5,826,349 | A | 10/1998 | Goss | |
| 5,829,172 | A | 11/1998 | Kaneko | |
| 5,830,553 | A | 11/1998 | Huang | |
| 5,832,634 | A | 11/1998 | Wong | |
| 5,845,417 | A | 12/1998 | Reed et al. | |
| 5,860,225 | A | 1/1999 | O'Dwyer | |
| 5,893,219 | A | 4/1999 | Smith et al. | |
| 5,915,820 | A | 6/1999 | Kraeuter et al. | |
| 5,937,462 | A | 8/1999 | Huang | |
| 5,953,835 | A | 9/1999 | Kwon | |
| 5,987,779 | A | 11/1999 | Litchfield et al. | |
| 5,992,052 | A | 11/1999 | Moretti | |
| 5,996,250 | A | 12/1999 | Reed et al. | |
| 6,014,823 | A | 1/2000 | Lakic | |
| 6,044,577 | A | 4/2000 | Clark | |
| 6,092,305 | A | 7/2000 | Troy et al. | |
| 6,134,812 | A | 10/2000 | Voss | |
| 6,161,240 | A | 12/2000 | Huang | |
| 6,195,914 | B1 | 3/2001 | Otis | |
| 6,247,248 | B1 | 6/2001 | Clark | |
| 6,298,499 | B1 | 10/2001 | Huang | |
| 6,457,262 | B1 * | 10/2002 | Swigart | 36/29 |
| 6,505,420 | B1 * | 1/2003 | Litchfield et al. | 36/29 |
| 6,553,691 | B2 | 4/2003 | Huang | |
| 6,785,985 | B2 | 9/2004 | Marvin et al. | |

FOREIGN PATENT DOCUMENTS

| | | |
|---|---|---|
| CA | 1143938 | 11/1982 |
| CA | 1230225 | 3/1986 |
| DE | 352167 | 4/1922 |
| DE | 820869 | 11/1951 |
| DE | 867585 | 2/1953 |
| DE | 917173 | 8/1954 |
| DE | 2005365 | 9/1970 |
| DE | 2321817 | 11/1973 |
| DE | 2308547 | 8/1974 |
| DE | 2365329 | 9/1974 |
| DE | 2456612 | 6/1975 |
| DE | 2800359 | 7/1979 |
| DE | 2845824 | 11/1980 |
| DE | 3245182 | 5/1983 |
| DE | 3205264 | 8/1983 |
| DE | 3427644 | 1/1986 |
| DE | 8802338 | 8/1989 |
| EP | 229273 | 7/1978 |
| EP | 40189 | 11/1981 |
| EP | 152401 | 8/1985 |
| EP | 184781 | 6/1986 |
| EP | 352807 | 1/1990 |
| EP | 389215 | 9/1990 |
| EP | 472110 | 2/1992 |
| EP | 629360 | 12/1994 |
| EP | 630592 | 12/1994 |
| EP | 1074193 | 2/2001 |
| FR | 601166 | 4/1926 |
| FR | 720257 | 2/1932 |
| FR | 1204093 | 1/1960 |
| FR | 2026062 | 9/1970 |
| FR | 2180315 | 11/1973 |
| FR | 2252820 | 6/1975 |
| FR | 2356384 | 1/1978 |
| FR | 2484215 | 12/1981 |
| FR | 2496423 | 6/1982 |
| FR | 2614510 | 4/1987 |
| FR | 2670369 | 6/1992 |
| GB | 14955 | 0/1894 |
| GB | 23547 | 0/1900 |
| GB | 26637 | 0/1897 |
| GB | 288671 | 9/1927 |
| GB | 338266 | 6/1930 |
| GB | 520514 | 12/1939 |
| GB | 817524 | 7/1959 |
| GB | 878832 | 1/1962 |
| GB | 2039717 | 8/1980 |
| GB | 2114425 | 8/1983 |
| GB | 2114425 A * | 8/1983 |
| GB | 2114869 | 9/1983 |
| GB | 2165439 | 4/1986 |
| GB | 2240254 | 7/1991 |
| GB | 2271710 | 4/1994 |
| JP | 1-164804 | 6/1989 |
| TW | 95419 | 2/1988 |
| WO | WO 87/03789 | 7/1987 |
| WO | WO 89/10074 | 11/1989 |
| WO | WO 90/04323 | 5/1990 |
| WO | WO 91/16830 | 11/1991 |
| WO | WO 91/18527 | 12/1991 |
| WO | WO 93/14659 | 8/1993 |
| WO | WO 93/21790 | 11/1993 |

OTHER PUBLICATIONS

Gore Filtration/Separations Venting—Venting Product Description-© 1998, 2000.

Superflate by Innovations in Cycling, Inc., Interbike Buyer 1991 International.

Runner's World, pp. 58-59, 69 and 74 (Apr. 1991).

Running Times, pp. 23 and 26 (Apr. 1991).

Ann. Interbike 1991 Int'l. Bicycle Expo.

* cited by examiner

ARTICLE OF FOOTWEAR INCORPORATING A FLUID SYSTEM

CROSS-REFERENCE To RELATED APPLICATION

This non-provisional U.S. Patent Application is a continuation application of U.S. patent application Ser. No. 11/053,697, which was filed in the U.S. Patent and Trademark Office on Feb. 7, 2005 and entitled Footwear With Bladder Filter, which has issued as U.S. Pat. No. 7,210,249. U.S. patent application Ser. No. 11/053,697 is a continuation application of U.S. patent application Ser. No. 09/887,523, which is now abandoned and was filed in the U.S. Patent and Trademark Office on Jun. 21, 2001 and entitled Footwear With Bladder Filter. Each prior U.S. Patent Application is entirely incorporated herein by reference.

BACKGROUND OF THE INVENTION

1. Field of the Invention

The present invention relates to footwear. More particularly, the present invention relates to a filter system that prevents water, other liquids, and particulates from obstructing the operation of components located within an article of footwear.

2. Description of Background Art

The principal objectives of modern athletic footwear design are to minimize weight while maximizing comfort, cushioning, stability, and durability. In order to meet this goal, footwear designers use a broad range of materials, shoe design techniques, and shoe-making methods. The basic design of athletic footwear, however, remains largely uniform.

Typical athletic footwear includes two primary elements, an upper and a sole. Usually formed of leather, synthetic materials, or a combination thereof, the purpose of the upper is to comfortably secure the wearer's foot to the sole while providing necessary ventilation. Attached to the upper is the sole. The sole ordinarily has a multi-layer construction which includes an insole, midsole, and outsole. The insole commonly consists of a thin padded member placed within the upper to enhance shoe comfort. The midsole forms the middle layer of the sole and typically includes a resilient foam material that cushions the foot from the impact forces of running, walking, or other movement. The outsole is usually formed of a durable material, such as synthetic or natural rubber, to resist wear during use. In many cases, the outsole incorporates a textured surface to enhance traction.

An alternate midsole construction, disclosed in U.S. Pat. No. 4,183,156 (patented Jan. 15, 1980 to Marion F. Rudy), incorporated by reference, includes a midsole component in which cushioning is provided by a fluid-filled bladder formed of elastomeric materials. The bladder includes a plurality of tubular chambers which extend longitudinally through the length of an article of footwear. The various tubular chambers are in fluid communication and jointly extend across the width of the footwear. U.S. Pat. No. 4,219,945 (patented Sep. 2, 1980 to Marion F. Rudy), incorporated by reference, discloses a fluid-filled bladder encapsulated within a foam material. The combination of the bladder and the encapsulating foam material functions as a midsole. An upper may be cemented to the upper surface of the encapsulating foam material and an outsole may be affixed to the lower surface.

The fluid-filled bladders disclosed in the '156 and '945 patents utilize a gas with a large molecular size that cannot diffuse through the bladder walls. In contrast, other bladder devices, including the bladders disclosed in U.S. Pat. No. 4,912,861 (patented Apr. 3, 1990 to Ing-Chung Huang); U.S. Pat. No. 5,335,382 (patented Aug. 9, 1994 to Yin-Jun Huang); and U.S. Pat. No. 5,937,462 (patented Aug. 17, 1999 to Ing-Chung Huang), which are incorporated by reference, use ambient air as the inflation gas. Unlike a gas with a large molecular size, air diffuses through bladder walls. Accordingly, those bladders that use air as an inflation gas frequently include pumps or other inflation devices to inflate the bladder with air. In addition, such bladders include valves that prevent the air from escaping through the inlet.

Over time, water and a variety of particulates, including dust, dirt, small rocks, plants, cleaning solutions, oils, cosmetics, and paint, may enter bladders, pumps, and valves in systems that include ambient air inlets. The bladders, pumps, and valves may, therefore, develop particulate deposits or mold growths that detrimentally affect performance of the bladder pumping system or the valves that prevent air from escaping. Accordingly, the art requires an improved ambient air-filled bladder that prevents substantial amounts of liquids and particulates from entering the bladder and detrimentally affecting bladder performance.

SUMMARY OF THE INVENTION

The present invention relates to an article of footwear for receiving a foot of a wearer. The article of footwear includes an upper for covering at least a portion of the wearer's foot, a sole structure attached to the upper, and an air-filled bladder in fluid communication with ambient air and attached to the article of footwear. In addition, the footwear includes a filter in fluid communication with the bladder and ambient air, the filter being structured to permit ambient air to enter the bladder and restrict liquids and particulates from entering the bladder.

In one embodiment, the filter is located on the outer surface of the footwear and a bladder is located in the sole structure. As the wearer walks or runs, air passes through the filter and the bladder is inflated. The purpose of the filter is to prevent liquids and particulates from entering the system, thereby adversely affecting the aesthetic properties of the footwear and the mechanical properties of the bladder and other components. For example, dust and water may collect in portions of the bladder that are visible, thereby detracting from the aesthetic properties of the footwear. Furthermore, deposits of liquids and particulates may prevent components of the invention from functioning properly.

A variety of materials may be used for the filter, including polytetrafluoroethylene, expanded polytetrafluoroethylene, high density polyethylene, ultrahigh molecular weight polyethylene, polyvinylidene fluoride, polypropylene, and ceramic filter materials. In order to assist in preventing water and other liquids from entering the system, the filter may be both hydrophobic and oleophobic. A perforated layer of material may be placed over exterior portions of the filter to protect and support the filter.

Various advantages and features of novelty which characterize the invention are pointed out with particularity in the claims. However, for a better understanding of the invention, its advantages, and objects obtained by its use, reference should be made to the drawings, and to the accompanying descriptive matter, in which there is illustrated and described preferred embodiments of the invention.

DETAILED DESCRIPTION OF THE INVENTION

Figure 1:
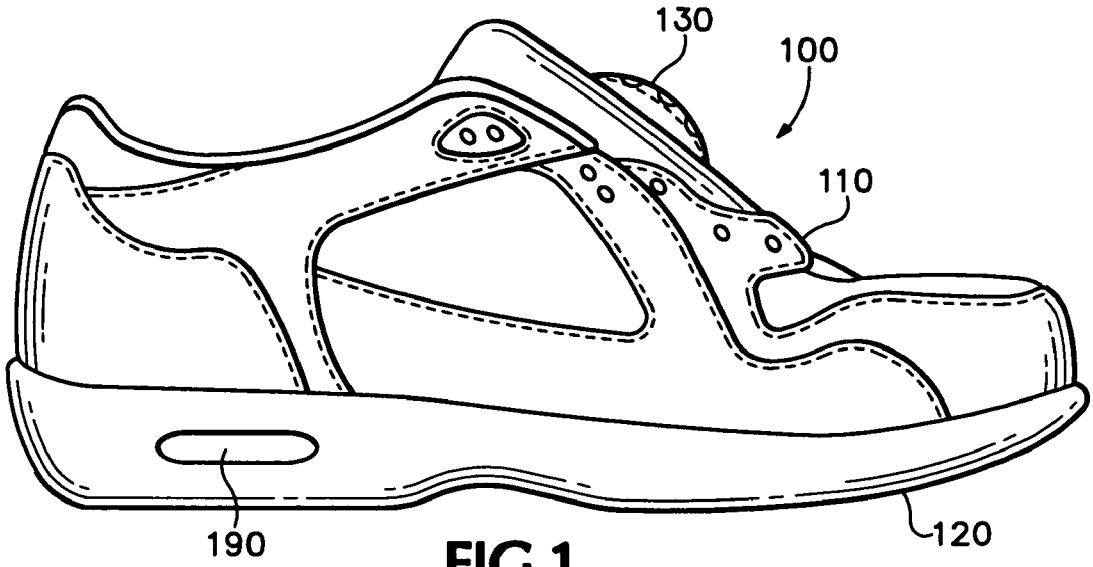
FIG. 1 is a side view of an article of footwear having a bladder system according to a first embodiment of the present invention.

Referring to the drawings, wherein like numerals indicate like elements, an article of footwear in accordance with the present invention is disclosed. The figures illustrate only the article of footwear intended for use on the right foot of a wearer. One skilled in the art will recognize that a left article of footwear, such article being the mirror image of the right, is included within the scope of the present invention.

As depicted in FIG. 1, footwear 100 is an article of athletic footwear, particularly a running shoe. Footwear 100 may, however, be any style of footwear, including a cross-training shoe, tennis shoe, basketball shoe, walking shoe, in-line skate, ski boot, hiking boot, work boot, sandal, dress shoe, or loafer. Footwear 100 includes an upper 110 attached to a sole structure 120. The configuration of upper 110 and sole structure 120 may vary in accordance with the style of footwear, but should permit the incorporation of other components, as described below.

Figure 2:
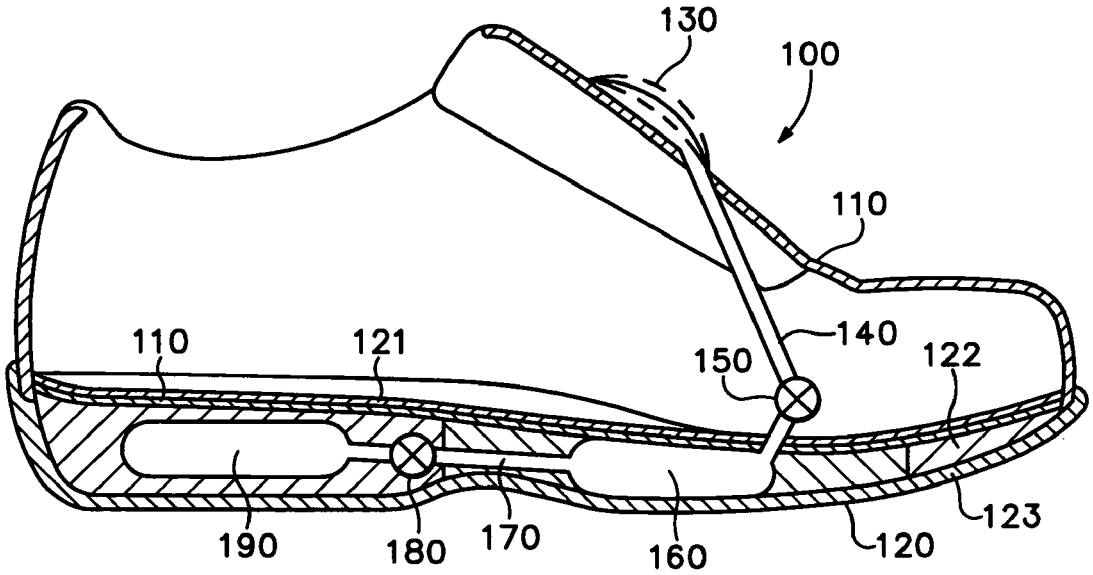
FIG. 2 is a cross-sectional view of the article of footwear depicted in FIG. 1.

Sole structure 120, as depicted in FIGS. 1 and 2, includes an insole 121, a midsole 122, and an outsole 123. Insole 121 is a thin, shock-absorbing member located within upper 110 and beneath a foot of a wearer that functions to enhance the comfort of footwear 100. Midsole 122 is attached to the lower surface of upper 110 and may be formed of a foam material, such as polyurethane, phylon, or ethylene vinyl acetate, that absorbs impact forces when footwear 100 contacts a playing surface. Outsole 123 is attached to the lower surface of midsole 122 and may be formed of a durable, wear-resistant polymer, such as carbon-black rubber compound. The lower surface of outsole 123 may be textured to provide enhanced traction when contacting the playing surface. In certain articles of footwear, one or both of the insole and outsole layers may be removed. When both the insole and outsole layers are removed, a single layer of material functions as the entire sole structure. Alternatively, sole structure 120 may have a configuration that does not include a foam material.

In addition to upper 110 and sole structure 120, footwear 100 includes a plurality of components that may be arranged in a plurality of configurations. In a first embodiment, described in detail below, the components combine to form a system having an ambient air-filled bladder that provides enhanced shock-absorbing properties to footwear 100. In a second embodiment, an alternate method of providing enhanced shock-absorbing properties is disclosed. In a third embodiment, also described below, the components combine to form a system that ventilates a foot received within upper 110.

Figure 3:
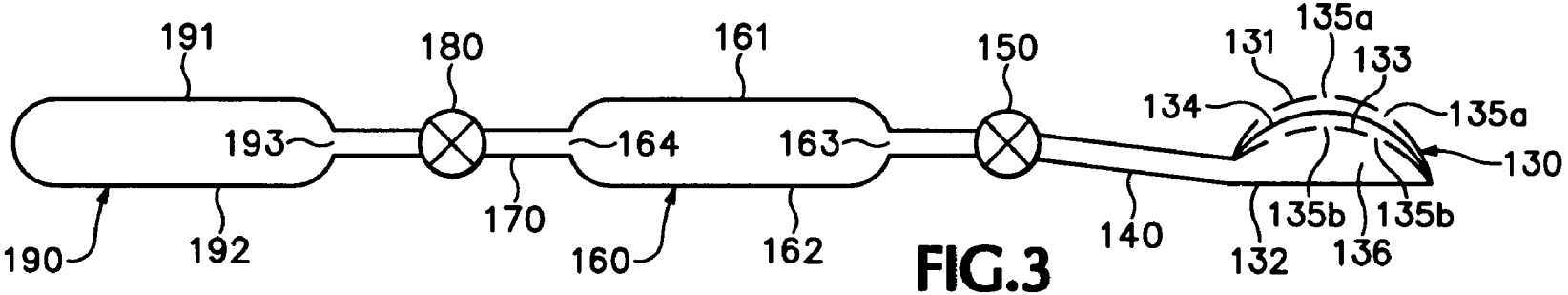
FIG. 3 is a schematic view of the bladder system according to the first embodiment of the present invention.

With regard to the first embodiment, depicted in FIGS. 2 and 3, footwear 100 also includes a filter structure 130 that permits air to enter a first conduit 140 but restricts the entry of liquids and particulates. Conduit 140, which may include a first valve 150, places filter structure 130 in fluid communication with a pump 160. A second conduit 170, which may include a second valve 180, places pump 160 in fluid communication with a bladder 190. Accordingly, air may pass through filter structure 130 and, through the action of the various components, enter bladder 190.

The purpose of the various components of the first embodiment are to inflate bladder 190 with air, thereby providing midsole 122 with enhanced shock-absorbing properties. When worn by an individual, during running for example, footwear 100 repetitively contacts the playing surface and, following each contact, disengages from the playing surface. When in contact with the playing surface pump 160 is compressed by the weight of the wearer. As footwear 100 disengages from the playing surface, pump 160 returns to an uncompressed configuration, thereby decreasing the pressure within pump 160 below the atmospheric pressure. The pressure differential between pump 160 and the atmosphere draws air through filter structure 130 and into first conduit 140. The air then passes through first valve 150 and enters pump 160, thereby equalizing the pressure between pump 160 and the atmosphere. When outsole 123 again makes contact with the playing surface, the force of the wearer's body compresses pump 160 and increases the pressure of the air in pump 160. Due to the increased pressure, air is forced into second conduit 170, passes through second valve 180, and enters bladder 190. Note that first valve 150 permits air to pass from first conduit 140 into pump 160, but prevents air from exiting in the opposite direction. Similarly, second valve 180 permits the passage of air into bladder 190, but prevents the passage of air in the opposite direction. In this manner, bladder 190 is placed in fluid communication with ambient air through filter structure 130, which is also in fluid communication with ambient air.

As noted above, pump 160 returns to an uncompressed configuration when footwear 100 disengages from the playing surface. When incorporated into midsole 122, the expansion of midsole 122 following compression may provide a means that is sufficient to return pump 160 to an uncompressed configuration. Further means, however, may be necessary in situations where midsole 122 is not sufficient to return pump 160 to an uncompressed configuration or where pump 160 is not located in a midsole. The further means may include a spring or element of foam that is positioned within pump 160. In addition, the further means may rely upon the inherent tendency of pump 160 to return to the uncompressed state.

Figure 4:
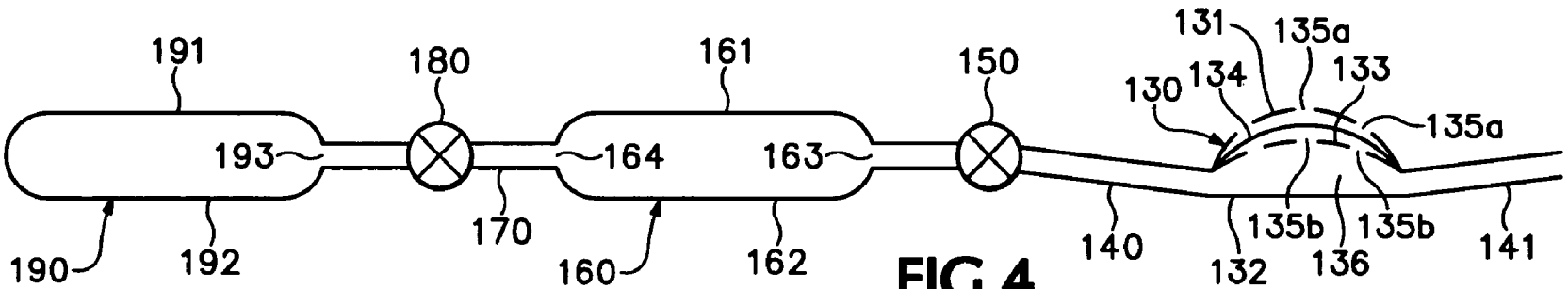
FIG. 4 is a schematic view of a bladder system according to a variation of the first embodiment of the present invention.

Other configurations, which use similar components may be used without departing from the scope of the present invention. For example, first valve 150 may be located adjacent to pump 160 or inside pump 160. In another alternate configuration, a third conduit 141 may be added such that air must pass through third conduit 141 before passing through filter structure 130, as depicted in FIG. 4. Moreover, multiple pumps 160 and bladders 190 may be disposed within footwear 100.

Filter structure 130 prevents water, other liquids, and a variety of particulates from hindering the operation of various system components, such as first valve 150, pump 160, and second valve 180, and bladder 190. If permitted to enter the system, particulates, for example, could collect around first valve 150 such that air is permitted to freely return from pump 160 to filter structure 130, thereby escaping to the atmosphere and decreasing the resulting pressure in bladder 190. In addition, water and particulates could collect in bladder 190 and become visible from the exterior of footwear 100, thereby decreasing the aesthetic properties of footwear 100. If water were permitted to enter bladder 190 or other portions of the system, the weight of footwear 100 may be increased significantly. Furthermore, particulates may act as an abrasive that wears away portion of the system, thereby decreasing durability. Accordingly, filter structure 130 acts to prevent the entry of liquids and particulates that may have a detrimental effect upon the system.

Figure 5A:
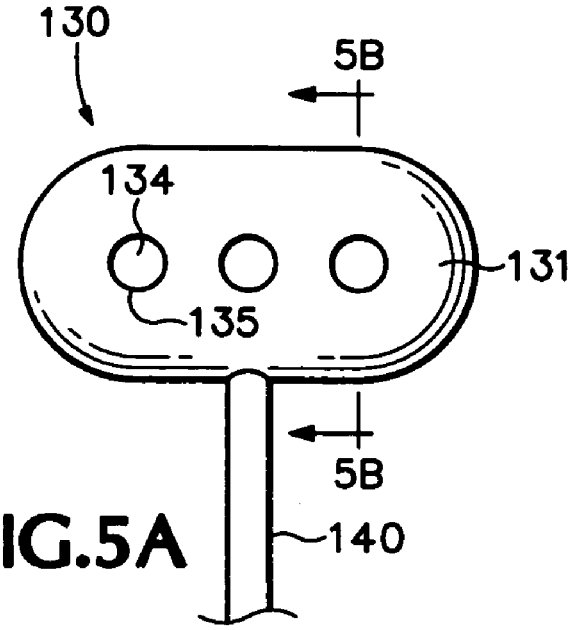
FIG. 5A is a plan view of a filter structure according to the first embodiment of the present invention.
Figure 5B:
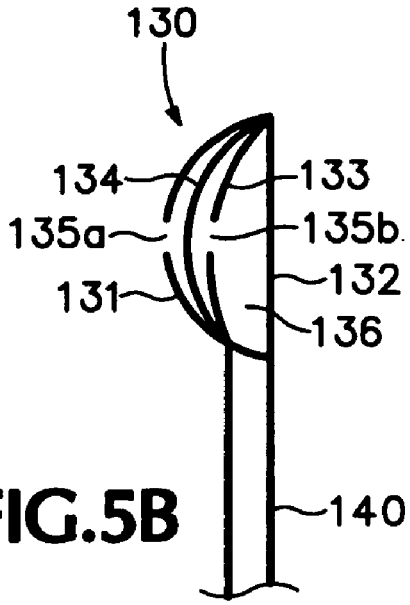
FIG. 5B is a cross-sectional view of the filter structure depicted in FIG. 5A.

With reference to FIGS. 5A and 5B, filter structure 130 includes a first sheet 131, a second sheet 132, an intermediate sheet 133, and a filter 134. In general filter 134 is a semi-porous medium through which air must pass in order to enter first conduit 140 and, thereafter, bladder 190. First sheet 131 and intermediate sheet 133 are located on opposite sides of filter 134 and provide support and protection to filter 134. Perforations 135*a* in first sheet 131 and perforations 135*b* in intermediate sheet 133 permit air to pass through filter 134 and enter a recess 136 which is in fluid communication with first conduit 140. Second sheet 132, in combination with intermediate sheet 133, forms recess 136. Alternate filter structure configurations may also be used without departing from the scope of the present invention. For example, intermediate sheet 133 may be absent from filter structure 130. In addition, first conduit 140 could include a flared end to which filter 134 may be attached, thereby abrogating the need for first sheet 131, second sheet 132, and intermediate sheet 133.

In order to provide protection to filter 134 and permit filter 134 to have a sufficient surface area, first sheet 131 and intermediate sheet 133 may be bonded to the perimeter of filter 134. This configuration permits air to pass through perforations 135*a* in first sheet 131, pass between first sheet 131 and filter 134, and then pass through filter 134 and perforations 135*b*, thereby increasing the effective area of filter 134 beyond that which is directly exposed by perforations 135*a*. Filter 134 may also have a corrugated configuration so as to facilitate air flow to all portions of filter 134 and effectively increase the surface area of filter 134.

Perforations 135 may be a plurality of small holes or a lesser number of large holes in first sheet 131 and intermediate sheet 133. To ensure that air passes freely through at least a portion of filter 134, perforations 135*a* may be aligned with perforations 135*b*. In addition to providing a means for air to contact filter 134, perforations 135*a* may also act as a coarse filter to prevent larger objects and particulates from contacting, and thereby damaging, filter 134. A screen, which may be formed of a porous material, a fabric, or a foam, may be attached to the exterior of filter structure 130 if filter 134 requires additional protection.

The materials from which filter 134 may be formed should conform to general concepts that relate to air flow rate, water entry pressure, particulate size, and operating temperature. With regard to air flow rate, filter 134 should permit air to flow at a rate that sufficiently inflates pump 160 between successive strides of the wearer. That is, filter 134 should exhibit a minimum air flow rate that permits pump 160 to expand from a state of complete compression by drawing air through filter 134 during each discrete time interval in which pump 160 is not compressed. For example, the time interval may be when the wearer's foot is not in contact with a playing surface during a single stride of the wearer. As such, the variables upon which the minimum air flow rate depend are the time between successive strides of the wearer and the volume of pump 160. Any filter material that permits the passage of air may be configured to exhibit the minimum air flow rate given a sufficiently large filter area. For example, a substantial portion of the exterior of upper 110 could be comprised of a filter material that is in fluid communication with bladder 190. An exemplary, practical filter area, however, would be within the range of 0.1 and 1 square inches. As one skilled in the art will recognize, particulate deposits or the presence of liquids on the exterior of filter 134 may inhibit air flow. Accordingly, the considerations discussed above should be adjusted to account for decreased air flow due to the presence of foreign materials.

In addition to a minimum air flow rate, filter 134 should be selected to have a minimum water entry pressure that prevents the passage of water at a pressure differential equal to the vacuum pressure created by the expansion of pump 160. As pump 160 expands, a vacuum is created within pump 160, first conduit 140, and recess 136. The pressure differential on opposite sides of filter 134 acts to draw air into recess 136. In addition, the pressure differential may induce the passage of liquids that are present on the exterior of filter 134. As such, a filter material should be selected with a water entry pressure that prevents water from passing through filter 134 at a pressure differential equal to the vacuum pressure created by the expansion of pump 160. A greater water entry pressure, however, may be more desirable. For example, the wearer of footwear 100 may step into a puddle or immerse footwear 100 in a lake or pool. In these situations, the static pressure of the water on the exterior of filter 134 in combination with the vacuum pressure may create a pressure differential that is significantly greater than the pressure differential created by vacuum pressure alone. Accordingly, a filter that prevents the entry of water at pressures greater than the vacuum pressure of pump 160 may be necessary to prevent the passage of water in many circumstances. Note that air flow rate and water entry pressure are generally inversely related. As such, a filter material having a high water entry pressure typically has a low air flow rate. One skilled in the art may reconcile these competing concerns.

The material selected for filter 134 should also block particulates that may decrease the aesthetics of footwear 100 or be detrimental to the performance of first valve 150, second valve 170, or pump 160, including dust, dirt, small rocks, plants, cosmetics, food, and paint. In general, the smallest visible particle has a size of approximately 50 microns; bacteria ranges in size from 0.4 microns to 11 microns; and certain endotoxins average 0.01 microns. As with water entry pressure, an inverse relationship also exists between the particulate size that may freely pass through a filter material and the air flow rate. As with water entry pressure, however, a filter material that blocks relatively small particles typically has a low air flow rate. Again, one skilled in the art may reconcile these competing concerns. With respect to the present invention, an adequate particulate blockage size may range from 1 to 3 microns.

With respect to water and other liquids, it is desirable that filter 134 be both hydrophobic and oleophobic. In other words, filter 134 should repel water and oil that may build up on the outer surface. Liquids that adhere to the outer surface may block pores that would otherwise permit air to pass. In addition, such liquids are likely to be drawn into the system when the minimum water entry pressure is exceeded. A filter material that repels water and oil will, therefore, be less likely to draw water or oil into the system.

Finally, filter 134 should operate under a variety of environmental conditions. In general, the criteria relating to water entry pressure should be sufficient to prevent water from entering the bladder system during rain or snow conditions. In addition, filter 134 should be able to function properly following exposure to temperature extremes, perhaps ranging from negative 10 degrees Fahrenheit to positive 175 degrees Fahrenheit.

One suitable material for filter 134 is polytetrafluoroethylene (PTFE) which is disposed on a substrate material. PTFE exhibits the required characteristics and is suitably durable when attached to a substrate such as non-woven polyester. A variation upon the standard formulation of PTFE is expanded polytetrafluoroethylene (ePTFE) which is manufactured by, for example, W.L. Gore & Associates. In addition to PTFE, other suitable materials for filter 134 include high density polyethylene, ultrahigh molecular weight polyethylene, polyvinylidene fluoride, polypropylene, and certain ceramic filter materials. Knit materials, woven materials, nonwoven materials, laminate structures consisting of one or more differing filter materials, and paper may also be suitable. In addition, filter structure 130 may be formed of a solid, porous material.

First conduit 140 provides a means for air to pass from recess 136 to pump 160. As depicted in FIGS. 2 and 3, first conduit 140 includes first valve 150. Similarly, second conduit 170 provides a means for air to pass from pump 160 to bladder 190 and includes second valve 180. First valve 150 and second valve 180 may be one-way or two-way valves that permit air to pass from recess 136 to pump 160 and from pump 160 to bladder 190, respectively. Suitable valves include those that are disclosed in the '861, '382, and '462 patents to Huang; duckbill check valves manufactured by Vernay; valves manufactured by A.C. Hoffman Engineering Inc.; and the valves disclosed in U.S. Pat. No. 5,144,708 (patented Sep. 8, 1992 to Robert W. Pekar).

As noted, first valve 150 may be a one-way or two-way valve. The primary function of first valve 150 is to prevent the flow of air from pump 160 to filter 134. Under some circumstances, it may be desirable to limit the pressure within pump 160. Accordingly, a two-way valve that permits air to flow from pump 160 to filter 134 only after a predetermined pressure is achieved within pump 160 may be used.

The length of first conduit 140 must be sufficient to connect filter structure 130 with pump 160. As depicted in FIG. 2, filter structure 130 is located on the instep portion of upper 110 and pump 160 is located in midsole 122. Accordingly, first conduit 140 extends from an edge of midsole 122 and passes through upper 110 to connect with filter structure 130. Filter structure 130 may be located in a plurality of locations, including, the heel area of the sole, the medial or lateral side of the ankle region, or on the interior of upper 110. In determining the locations of first conduit 140 and filter structure 130, consideration should be given to the possibility that water or other liquids may contact filter 134. To reduce the probability that filter structure 130 will be exposed to water, filter structure 130 may be located on portions of footwear 100 at relatively greater elevations.

Pump 160 includes a first sheet 161, a second sheet 162, an inlet 163, and an outlet 164. One purpose of pump 160 is to provide a volume of less than ambient pressure air that draws air through filter structure 130 and, thereafter, through inlet 163. The volume of less than ambient pressure air is created when first sheet 161 and second sheet 162 are separated as midsole 122 expands. As midsole 122 disengages from the playing surface, the compressive force decreases, and midsole 122 expands. The expansion of midsole 122 forces first sheet 161 and second sheet 162 to separate, thereby creating the volume of less than ambient pressure air. A second purpose of pump 160 is to provide an increase in pressure that forces air to exit pump 160 through outlet 164 and, thereafter, enter bladder 190. As midsole 122 contacts the playing surface and is compressed, the volume between first sheet 161 and second sheet 162 is decreased, thereby creating a volume of compressed air that exits pump 160 through outlet 164 and passes into bladder 190. Note that air will only pass into bladder 190 when the pressure of the air in pump 160 exceeds the pressure of the air in bladder 190. As noted above, other methods may be used to expand pump 160.

The air flow rate required of filter 134 may be dependent upon the volume of pump 160. In addition, the portion of first conduit 140 that is between first valve 150 and inlet 163 may also be added into the volume of pump 160. When midsole 122 is compressed, the air in this portion of first conduit 140 is also compressed, thereby adding to the pumping action of pump 160. Similarly, the portion of second conduit 170 that is between outlet 164 and second valve 180 may also be added into the volume of pump 160.

Pump 160 and bladder 190 may be manufactured, for example, using a two-film, blow-molding, or vacuum forming technique. If manufactured through a two-film technique, bladder 190 may include a first sheet 191, a second sheet 192, and an inlet 193 that connects with second conduit 170. In the two-film technique, two separate layers of elastomeric film are placed one on top of the other and welded together along the periphery and at predetermined interior areas. Examples of such bladders and the conventional welding technique may be found in the '156 and '945 Rudy patents.

One advantage of the two-film technique is that it may be used to integrally form many components of the system being discussed, including portions of filter structure 130, first conduit 140, pump 160, second conduit 170, and bladder 190. In accordance with the two-film technique, elements such as intermediate sheet 133, filter 134, and valves 150 and 180 are placed between two layers of elastomeric material which are then welded using, for example, one or more radio frequency welding operations. Following the welding operation, excess portions of the layers may be trimmed and the integrally formed components may be incorporated into footwear 100. Note that the two-film technique produces a system wherein first sheet 131, first sheet 161, and first sheet 191 may be formed from the first layer of the two-film technique. Alternatively, intermediate sheet 133, first sheet 161, and first sheet 191 may be formed from the first layer of the two-film technique. Similarly, second sheet 132, second sheet 162, and second sheet 192 may be formed from the second layer of the two-film technique. This continuity decreases the number of joints and connections between various components, thereby increasing the durability of the system.

Bladder 190 may also be manufactured through a blow-molding technique wherein a liquefied elastomeric material is placed in a mold having the desired overall shape and configuration of bladder 190. The mold has an opening at one location through which pressurized air is introduced. The pressurized air forces the liquefied elastomeric material against the inner surfaces of the mold and causes the material to harden. Examples of blow-molding techniques are disclosed in the '861, '382, and '462 patents to Huang, U.S. Pat. No. 5,353,459 to Potter et al., and U.S. Pat. No. 5,406,719 to Potter, which are incorporated by reference. The '719 patent discloses a technique for forming footwear bladders from separate sheets. U.S. Pat. No. 5,755,001 to Potter, which is also incorporated by reference, discloses a footwear bladder and bladder manufacturing technique wherein outer film layers are sealed together around their perimeters and are internally connected to one another by one or more internal sheets which act as tensile members. Other manufacturing techniques may also be used.

The material forming bladder 190 preferably prevents substantial quantities of air from diffusing through first sheet 191 and second sheet 192, thereby ensuring that bladder 190 remains inflated. Limited diffusion, however, may occur as the system of the first embodiment will replace escaped quantities of air. In addition, the material of bladder 190 should remain pliable and durable at both high and low operating temperatures. Suitable materials include those disclosed in the '156 and '945 patents to Rudy. One preferred material is thermoplastic polyurethane.

Figure 5C:
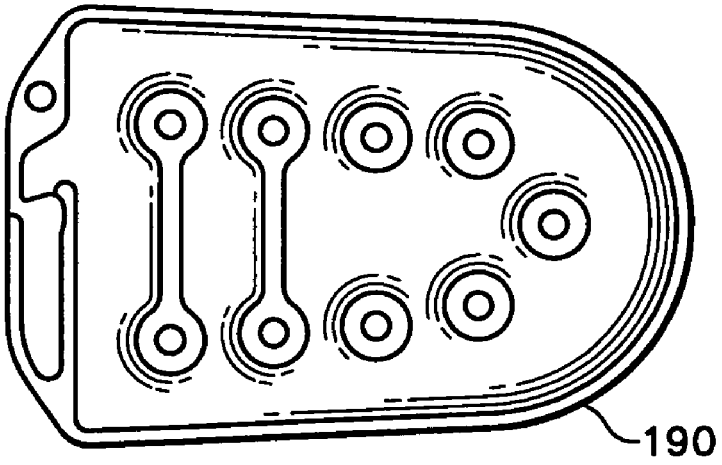
FIG. 5C is a schematic plan view of a bladder used in the first embodiment of the present invention.

The location of bladder 190, as depicted in FIG. 2, is in the heel region of footwear 100. An example of a suitable heel bladder 190, which is formed of two sheets of material, is shown in FIG. 5C. Bladder 190 is sealed around its U-shaped perimeter and includes linear and dot-shaped welds in interior portions A variety of bladder shapes, sizes, and locations may be used within the scope of the present invention. For example, bladder 190 may be located throughout the length and width of midsole 122, thereby underlying substantially the entire foot of the wearer. In addition, bladder 190 may be limited to one side of footwear 100 or may be located in the forefoot region. Moreover, multiple bladders may be located within a single article of footwear, a first bladder in the heel region and a second bladder in the forefoot region, for example.

In an exemplar system of the type discussed with reference to the first embodiment, filter 134 was formed of an expanded PTFE filter material having an area of 0.88 square inches. This area of filter 134 was sufficient to provide an air flow rate that inflated a pump 160 having a volume of 17 cubic centimeters. In turn, the volume of pump 160 was sufficient to fully inflate a bladder 190 having a volume of 63 cubic centimeters. Duckbill check valves manufactured by Vernay were used in both the first and second conduits 140 and 170.

Figure 6:
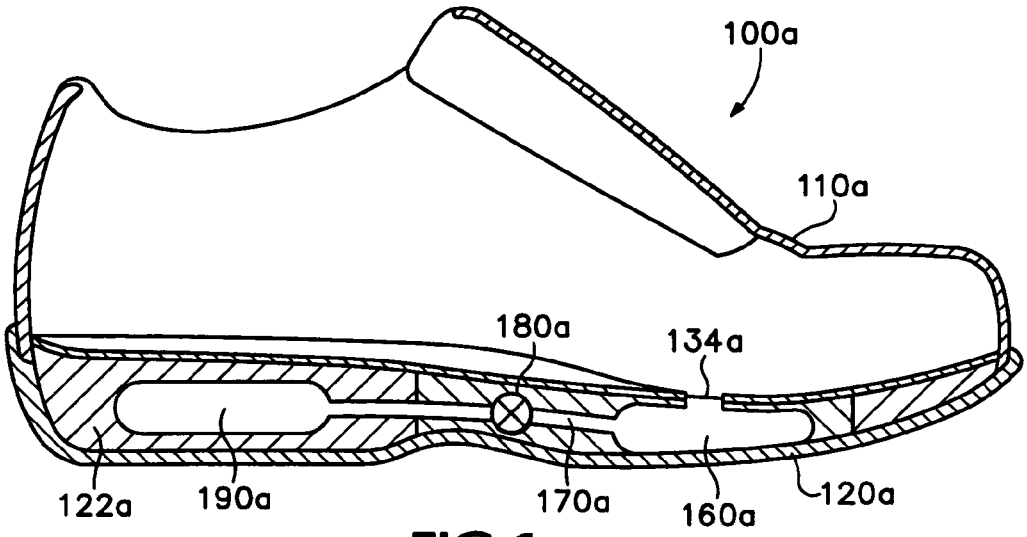
FIG. 6 is a cross-sectional view of an article of footwear having a bladder system according to a second embodiment of the present invention.

FIG. 6, which discloses the second embodiment of the present invention, depicts a cross-section of an article of footwear 100*a* having an upper 110*a*, a sole structure 120*a*, and a filter 134*a*. A pump 160*a* is located in the forefoot portion of footwear 100*a* and a bladder 190*a* is located in the heel portion of a midsole 122*a*. A conduit 170*a* having a valve 180*a* permits air to flow from pump 160*a* to bladder 190*a*. Filter 134*a* is attached to the upper surface of pump 160*a* such that air from within upper 110*a* may pass through filter 134*a* and enter pump 160*a*.

The purpose of this embodiment is to disclose an alternate means of inflating a bladder, in this case bladder 190*a*, to a pressure that is greater than atmospheric pressure. When footwear 100*a* is not in contact with the playing surface, midsole 122*a* and pump 160*a* are fully expanded. In this state, pump 160*a* becomes filled with air which is at approximately atmospheric pressure. When footwear 100*a* contacts the playing surface, the foot of the wearer covers filter 134*a* such that air may neither enter nor exit pump 160*a*. As impact forces compress midsole 122*a*, thereby compressing pump 160*a*, the pressure of the air within pump 160*a* increases and air passes through conduit 170*a* and valve 180*a*, thereby entering bladder 190*a*. When footwear 100*a* is lifted from the playing surface, the wearer's foot uncovers filter 134*a*, air enters pump 160*a*, and the process may repeat. Note that valve 180*a* prevents air from exiting bladder 190*a*.

Figure 7:
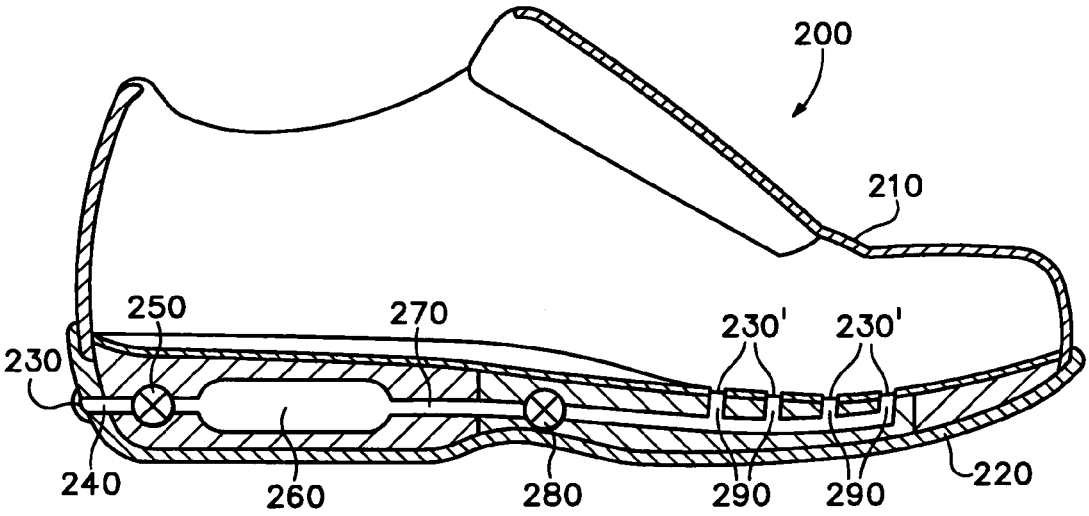
FIG. 7 is a cross-sectional view of an article of footwear having a bladder system according to a third embodiment of the present invention.

The third embodiment, depicted in FIG. 7, includes a filter material that is used in conjunction with a ventilation system. Footwear 200 includes an upper 210 and a sole structure 220. The ventilation system, which may be primarily located in sole structure 220, includes a filter 230 that permits air to flow into a first conduit 240. First conduit 240 includes a first valve 250 that permits air to flow into a bladder 260 but not in the reverse direction. A second conduit 270 leads from bladder 260 to a second valve 280. Beyond second valve 280, second conduit 270 branches into a plurality of ventilation conduits 290 that lead to the interior of upper 210. A plurality of filters 230' cover the ends of ventilation conduits 290 to prevent liquids and particulates from entering the system. In the alternative, a single section of filter 230' may be positioned so as to cover all of the ends of ventilation conduits 290. The compression of bladder 260 forces air into ventilation conduits 290 which then enters upper 210, thereby ventilating the interior of upper 210. As with other configurations, filters 230 and 230' prevents liquids or particulates from entering the system.

Numerous characteristics and advantages of the present invention have been described in detail in the foregoing description with reference to the accompanying drawings. However, the disclosure is illustrative only and the present invention is not limited to the precise illustrated embodiment. Various changes and modifications may be effected therein by persons skilled in the art without departing from the scope or spirit of the present invention.

That which is claimed is:

1. An article of footwear, comprising:

a first sheet of thermoplastic elastomeric film and a second sheet of thermoplastic elastomeric film, wherein said first sheet is welded to said second sheet to form an inflation mechanism and an inflatable bladder, wherein both said inflation mechanism and said inflatable bladder are formed by both said first sheet and said second sheet and wherein said inflation mechanism is monolithic with said inflatable bladder;

an air inlet fluidly connected to said inflation mechanism for introducing ambient air outside of said inflatable bladder to said inflation mechanism; and a valve, wherein said inflation mechanism is fluidly connected to said inflatable bladder through said valve, wherein said valve permits air flow from said inflation mechanism to said inflatable bladder, and wherein said valve limits air flow from said inflatable bladder to said inflation mechanism;

wherein said inflation mechanism is positioned so as to be operated by the downward pressure of a wearer's foot.

* * * * *